United States Patent [19]

Jones

[11] 4,227,509

[45] Oct. 14, 1980

[54] ARCHERY BOW HAVING CONTINUALLY DECREASING DRAW FORCE DURING DRAW

[75] Inventor: Glenn M. Jones, Roscommon County, Mich.

[73] Assignee: GEC Associates, Inc., Troy, Mich.

[21] Appl. No.: 886,764

[22] Filed: Mar. 15, 1978

[51] Int. Cl.[3] ..... F41B 5/00

[52] U.S. Cl. ..... 124/23 R; 124/86

[58] Field of Search ..... 124/23 R, 24 R, 41 A, 124/88, 90

[56] References Cited

U.S. PATENT DOCUMENTS

| | | | |
|---|---|---|---|
| 3,486,495 | 12/1969 | Allen | 124/24 R |
| 3,595,213 | 7/1971 | Storer | 124/22 UX |
| 3,851,638 | 12/1974 | Alexander | 124/24 R |
| 3,965,883 | 6/1976 | Meyer | 124/24 R |

*Primary Examiner*—Richard C. Pinkham
*Assistant Examiner*—William R. Browne

[57] ABSTRACT

An archery bow having limbs of adjustable resilient force with the draw poundage force necessary to maintain the bowstring at full draw being substantially less than conventional compound bows and with the propelling force on the arrow increasing substantially uniformly from a minimum at full draw to a maximum at the point immediately preceding free arrow flight. The resilient limbs flex in a direction away from the archer and have pivotally mounted force multiplying mechanisms at their ends interconnected by non-yieldable cables to the bow handle.

16 Claims, 5 Drawing Figures

ARCHERY BOW HAVING CONTINUALLY DECREASING DRAW FORCE DURING DRAW

BACKGROUND OF THE INVENTION

The basic design and theory of function of archery bows remained unchanged for centuries until the relatively recent introduction of the compound bow. Such a bow includes over center, force multiplying pulley mechanisms effective to increase the energy stored by flexing bow limbs of a given resiliency and to reduce the draw poundage force necessary to maintain the bowstring in partially to fully drawn positions after a maximum draw poundage force at a partially drawn position is reached. It thus is recognized that the compound bow, as exemplified by the disclosure of U.S. Pat. No. 3,486,495, issued Dec. 30, 1969, represents a technological advance of immense proportions in this art. Since the introduction of the compound bow, this design has achieved dramatic commercial success, with the vast majority of archery bows manufactured and sold today being of the compound type.

This success is due in large part to the "let off" characteristics of compound bows enabling a bow of relatively high poundage to be held at full draw during aiming with a greatly reduced force while generating a larger arrow propelling force. Archers of given strength thus skillfully may use compound bows of greater poundage and the propensity for archer shaking at full draw during critical aiming, due to the archer being extended toward his maximum strength capabilities, greatly is reduced. In this respect, compound bow let off characteristics in the neighborhood of fifty percent are available.

The archery bow of this invention was designed to further increase let off characteristics over those of conventional compound bows, while sacrificing little potential energy stored during bow draw, and to provide certain other advantages over such conventional bows. In particular, the presence of compound bow bowstring extensions and/or auxiliary strings between the nocking point and handle, which may be contacted by arrow fletching between arrow release and free flight to cause deviation from the aimed arrow path, are eliminated. The resilient limbs are reverse loaded from those of conventional bows to flex away from the archer; a significant advantage in the event of failure of a limb. The individual limbs of the bow of this invention have their resilient deformation characteristics altered and tuned relative to one another by simple mechanical adjustments, thus eliminating a time consuming task required of a highly skilled workman during bow manufacture.

In addition, it is well known that in conventional compound bow, subsequent to arrow release and before free flight, the maximum propelling force on the arrow occurs at a bowstring position intermediate the at rest and full positions. In contradistinction, the bow of this invention provides what may be termed a "rocket effect" since the arrow propelling force increases from the full draw-release position to a maximum immediately preceding arrow free flight, similar to the manner in which a rocket powered vehicle is given maximum velocity by the expenditure of maximum rocket engine power immediately before free flight. It is believed that this effect will lead to greater accuracy and arrow velocity in bow operation.

It is, therefore, an object of this invention to provide a reverse load compound bow of greatly increased let off characteristics while sacrificing only a small part of the stored energy capabilities of the resilient limbs as compared to conventional compound bows. A further object of this invention is to provide a compound bow that eliminates a potential danger to the archer in the event of resilient limb failure. Yet another object of this invention is to provide a bow with the advantages described above, but that lends itself to more simple and less costly manufacturing methods than do commercial compound bows.

SUMMARY OF THE INVENTION

An archery bow constructed in accordance with this invention includes a handle section provided with a pair of outwardly extending resilient limbs. A bowstring having a nocking point is connected by first means to the free end portion of each of the limbs such that the bowstring is positioned along one side of the limbs and the nocking point is movable from an at rest position to plurality of drawn, limb flexing positions upon application of drawing forces to said bowstring. Each of the limbs is arcuate in shape along its length and has a convex profile proximate the bowstring and a concave profile remote from the bowstring. Pivot means couple the first means to the limbs for relative movement between the first means and the limbs such that the magnitude of the drawing force necessary to hold the nocking point in a first drawn position is less than the force necessary to hold the nocking point in a second drawn position more distant from the at rest position than the first drawn position.

DETAILED DESCRIPTION OF THE INVENTION

Figure 1:
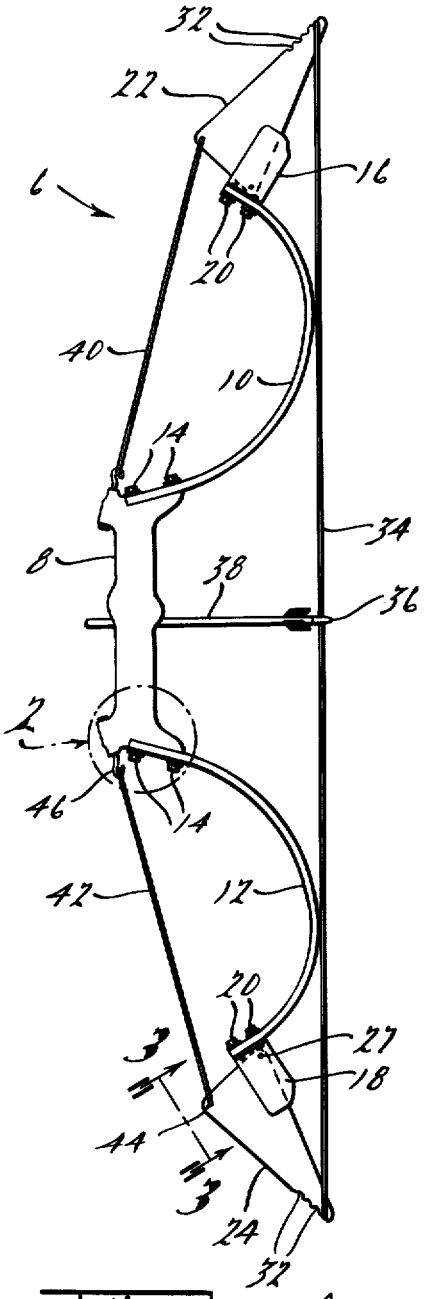
FIG. 1 is a side elevation view of the archery bow of this invention in an at rest position, and includes a portion of an arrow nocked preparatory to draw.

Referring now in detail to the drawings, and in particular to FIG.1 thereof, the numeral 6 denotes generally an archery bow constructed in accordance with this invention. Bow 6 includes a handle 8 that may be formed from magnesium or other suitable material and which has a central portion contoured as is conventional in the art. A pair of arcuate, resilient limbs 10 and 12 are secured to and extend from opposite ends of the elongate handle 8. Limbs 10 and 12 may be formed from any suitable bow limb material such as fiberglass, and are secured to the handle by fasteners 14, although it is possible and within the scope of this invention to form the handle and limbs as an integral one-piece member or to secure the limbs to a separate handle by "quick take down" expedients well known in the art. It is important to note that limbs 10 and 12 are oriented such that their convex elongate surfaces are proximate the archer using bow 6.

Figure 3:
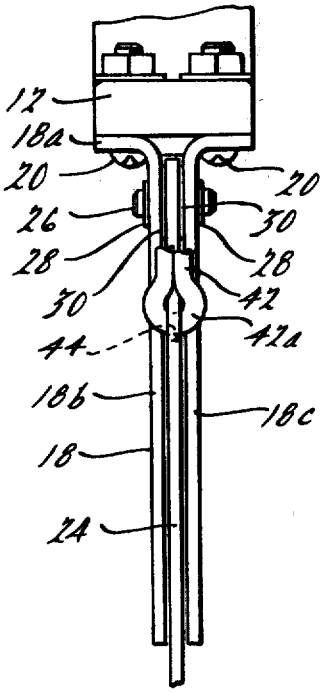
FIG. 3 is a partial view of the bow of FIG. 1, taken along the line 3—3 of FIG. 1.

Guide members 16 and 18 are secured to free end portions of limbs 10 and 12, respectively, by fasteners 20. As best seen in FIG. 3, guide member 18 has a base portion 18*a* through which a fastener element passes, and is bifurcated with a pair of arms 18*b* and 18*c* extending from base 18*a*. The shape of arms 18*b* and 18*c* is such that a generally planar space exists between them.

As is apparent from the drawings, bow 6 is symmetrical in construction so that guide member 16 is identical to guide member 18 and need not be described in detail herein. (In like manner and because of this symmetry, only the lower half of the structure of bow 6, as viewed in FIG. 1, will be described in detail).

Generally planar pivot members 22 and 24 are secured for relative pivotal movement to guide members 16 and 18, respectively. Pivot member 24 is positioned between arms 18*b* and 18*c* of guide member 18 (FIG. 3), and pivotally secured to the guide member by a pivot pin 26 that is held in place by snap rings 28 and 30, or any other suitable expedient. The pin 20 extends through a pair of washers 30, each of which is positioned between pivot member 24 and one of the guide member arms 18*b* or 18*c*. These washers facilitate swinging movement between the pivot member 24 and guide member 18, with the arms 18*b* and 18*c* of the guide member insuring that such pivotal movement of pivot member 24 occurs substantially in a plane between these arms. For purposes of later description, the pivot point between pivot member 24 and guide member 18 is designated by the numeral 27 in FIGS. 1 and 5.

Is should be noted that although the pivot members 22 and 24 are illustrated as being triangular, these members may be formed in many different shapes as will be apparent from the description of the functioning of bow 6 that follows. Also, it is important to the operation of bow 6 only that pivot members 22 and 24 be mounted for swinging movement in a plane relative to limbs 10 and 12. Thus schemes for mounting the pivot members other than illustrated easily could be employed in accordance with this invention. For example, the free end portions of limbs 10 and 12 could themselves be bifurcated by slots and the pivot members secured directly to the limbs within such slots without the inclusion of separate guide members, such slots functioning as guides.

A conventional bowstring 34 extends between pivot members 22 and 24, with the mounting of the looped bowstring ends to the pivot members facilitated by forward facing notches 32 formed in the pivot members. Each pivot member is illustrated as having formed therein a plurality of notches 32 to accomodate bowstrings of various lengths and archers of various draw length capabilities. Bowstring 34 has a nocking point 36 at which a conventional arrow 38 is illustrated as nocked.

A pair of cables 40 and 42 interconnect handle 8 and pivot members 22 and 24, respectively. Cable 42 has a loop 42*a* formed in one end thereof that extends through an aperture 44 in pivot member 24. (For descriptive purposes, the reference number 44 hereafter is described as the point of attachment between cable 42 and pivot member 24). The end of cable 42 remote from pivot member 24 is secured to a hook 46 by means of a loop 42*b* formed at the end of the cable. Hook 46 has a threaded shank 48 that extends into a bore 52 formed through handle 8 and is received in an internally threaded plug 50 positioned within an enlarged portion of the bore. An end cap 54 closes one end of bore 52. Plug 50 is seated against a thrust washer 56 at its end remote from cap 54.

It may be seen that by threading shank 48 of hook 46 into and out of plug 50, the effective length of cable 42 easily may be adjusted. The importance of this feature will be discussed in detail below.

Figure 4:
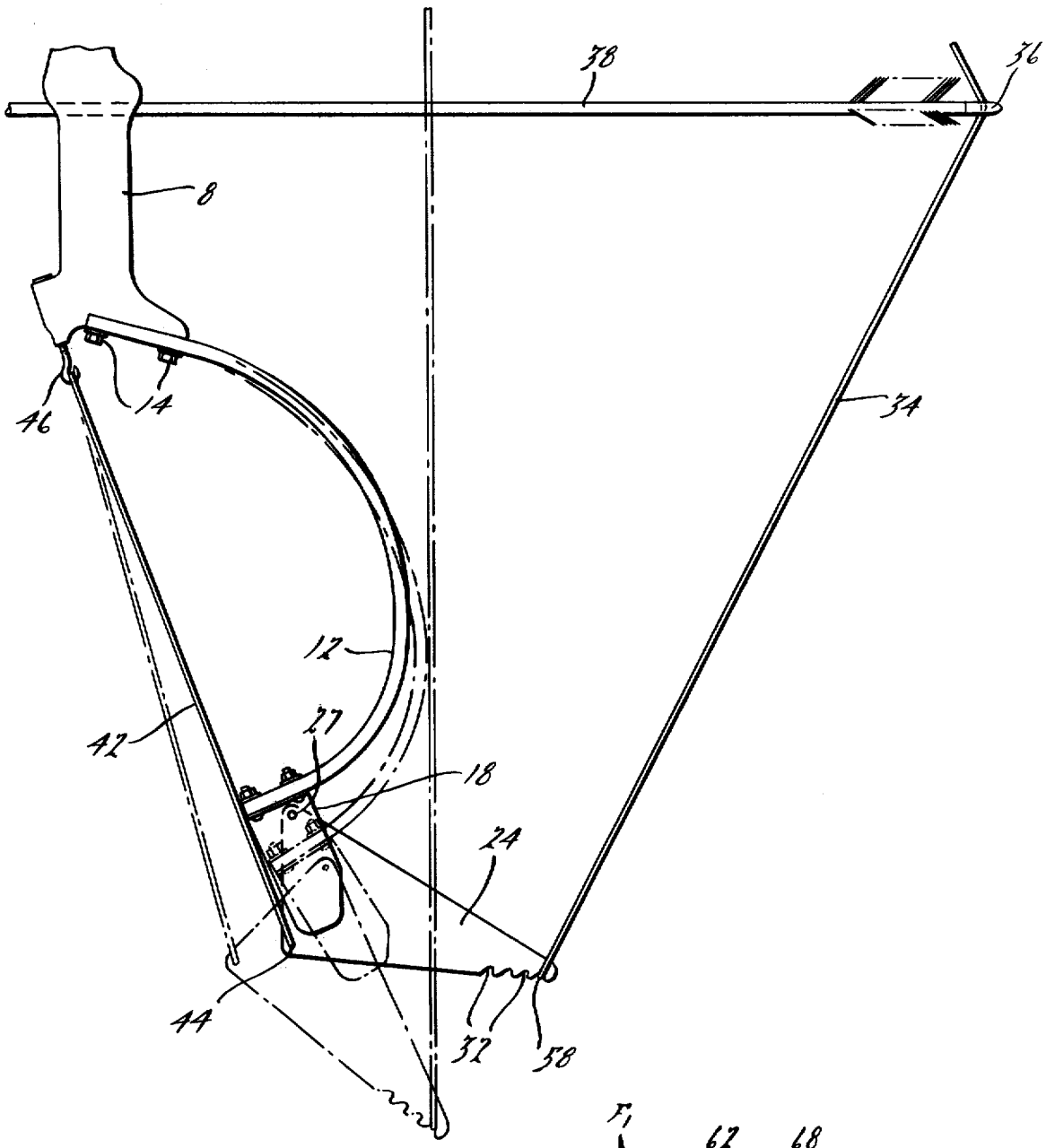
FIG. 4 is an enlarged side elevation view of one half of the bow of FIG. 1, and showing the bow parts at full draw in solid lines and the bow parts at rest in phantom.

By reference to FIG. 4 of the drawings, the manner in which bow 6 functions may be seen. As mentioned above, in FIG. 4, bow parts are shown in solid lines in the full draw position and in phantom lines in the at rest position of FIG. 1. For descriptive purposes, it is important to note three points on the geometry of the bow: pivot point 27, the attachment point 44 between cable 42 and pivot member 24, and a point designated by the reference number 58 comprising the point of attachment between bowstring 34 and pivot member 24.

When the archer has drawn the bow 6 to the fully drawn or a partially drawn position, a portion of the manual force generated by the archer is transmitted along bowstring 34 to the pivot member 24 and tends to cause the pivot member to rotate about pivot point 27. This rotation of pivot member 24 is limited, however, by cable 42 that is non-yieldable in tension, to a predetermined degree, depending on the effective length of the cable. Because pivot member 24 cannot rotate freely, a portion of the force transmitted by bowstring 34 is transmitted through pivot member 24 (a portion of which acts as a moment arm), pivot pin 26, and guide member 18 to resiliently deformable limb 12 as a moment, causing the limb to flex partially inwardly toward handle 8 and partially away from the archer. This flexing causes storing of potential energy to propel arrow 38.

The composite vector of the moment on limb 12 useful to flex the limb acts in a direction along a line normal to limb 12 and passing through pivot point 27. The magnitude of this moment causing flexing of limb 12 is, of course, dependent on the size of the effective moment arm provided by pivot member 24. The magnitude of this effective moment arm is proportional to the distance from point 58 to the imaginary line normal to limb 12 and passing through pivot point 27 and provides a mechanical advantage to flex the limb 12. It readily may be appreciated that as nocking point 36 is moved from the at rest position towards the fully drawn position, this distance, the moment arm and the resultant mechanical advantage all increase progressively. This progressive increase in mechanical advantage during drawing of the bow increases proportionally far in excess of the increase in resistance to flexing of the limb as it is flexed toward its full draw position.

The progressive mechanical advantage provided by bow 6 during drawing may be considered as dependent on the angular magnitude of the angle from nocking point 36 to attachment point 58 to pivot point 27. As this angle, which may be designated "36-58-27", increases in angular magnitude, the moment arm through pivot member 24 and the resultant mechanical advantage increase accordingly.

Because of the mechanical advantage of bow 6 described above, the maximum draw force necessary to maintain nocking point 36 in other than the rest position occurs immediately proximate the at rest position. This draw force progressively diminishes as the nocking point approaches full draw.

Figure 5:
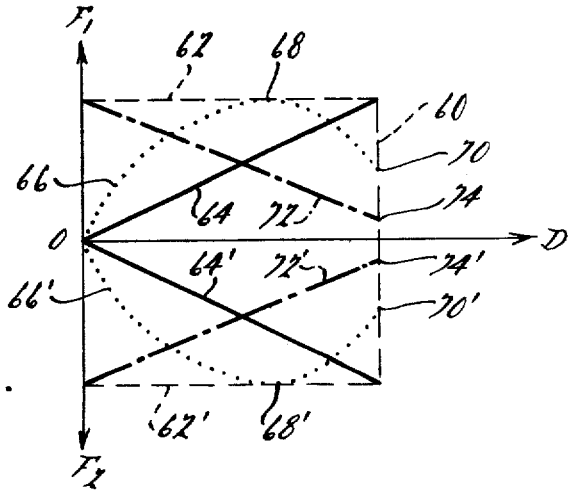
FIG. 5 is a graph showing the force-distance draw characteristics of the bow of this invention compared to conventional limb and compound bows.

The advantages of bow 6 described heretofore are illustrated in the graph of FIG. 5. The abscissa of the graph is identified by the letter D and plots the distance that the nocking point 36 is drawn. The distance of draw corresponding to the value of vertical broken line 60 is the maximum bow draw, approximately twenty-eight inches when conventional arrows are used. The ordinate of the graph plots the force applied to nocking point 58 by the archer and is divided into two components $F_1$ and $F_2$ that are identical in magnitude at any given distance D, since $F_1$ and $F_2$ values represent the forces required to flex limbs 40 and 42, respectively. Thus the force values represented by horizontal broken lines 62 and 62' represent the maximum poundage needed to flex the respective bow limbs.

Solid line curves 64 and 64' represent the performance characteristics of a conventional limb bow of the type known since antiquity. From the zero value of the force applied to the nocking point when the bow is at rest, the force values increase linearly during bow draw to the maximum at full draw at line 60. The potential energy stored by the flexed limbs is represented by the area between curves 64 and 64'. The disadvantages of bows of this type readily may be seen from FIG. 5. The maximum force exerted by the archer is required at full draw where the nocking point position must be held for aiming and, as will be seen from the following description, the stored energy is relatively small and the characteristics of energy application to propel the arrow disadvantageous.

Dotted curves 66 and 66' represent the performance characteristics of a conventional compound bow as is well known in the art and fully disclosed in previously mentioned U.S. Pat. No. 3,486,495. The buildup of stored energy for such a conventional compound bow occurs much more quickly during the draw (curves 66 and 66') than for the conventional limb bow (curves 64 and 64'), with the maximum limb flexing force being required at a partially drawn position represented by points 68 and 68'. As the draw proceeds past points 68 and 68', the required force decreases until the full draw position force levels represented by points 70 and 70'. This decrease or "let off" in full draw poundage of the compound bow, together with the greater stored energy between curves 66 and 66' as compared to curves 64 and 64' undoubtedly have caused the popularity and commercial success of the compound bow.

Dot-dash curves 72 and 72' represent the performance characteristics of the bow 6 of this invention. Since the moment arm mechanical advantage provided is at a minimum with the bow 6 at rest as explained above, the maximum limb flexing force required of the archer is applied at the commencement of the draw. At this time, the archer's hands are relatively close together permitting greater manual force application of the archer's natural strength. As the draw progresses, the required draw force progressively is reduced as the mechanical advantage provided by bow 6 increases until the full draw position and minimum draw force is reached at points 74 and 74'. (While curves 72 and 72' are illustrated in FIG. 5 as being straight lines, it is believed that for certain dimensions and material characteristics of bows constructed in accordance with this invention, these curves will be somewhat arcuate although still diminishing in force magnitude as bow draw progresses).

While the let off advantage of conventional compound bows (the distance between lines 62 and 62' and points 70 and 70', respectively) is in the neighborhood of fifty percent maximum draw force as mentioned above, it is believed that let off for a bow constructed in accordance with this invention (the distance between lines 62 and 62' and points 74 and 74') will be in excess of eighty percent of maximum draw force. The advantage of this characteristic of bow 6 for an archer, especially one of limited strength during aiming, and resulting accuracy performance readily may be appreciated.

While the stored energy represented by the area between curves 72 and 72' is greater than the energy area between curves 64 and 64', it is somewhat less than the energy area between curves 66 and 66' of the conventional compound bow. This smaller stored energy potential is believed to be more than offset by the many advantages of the bow of this invention, including the "rocket effect" produced by the characteristics of application of the stored energy by bow 6. Arrow propelling force, as can be seen from FIG. 5, increases from a minimum as the arrow is released at full draw until a maximum at the instant before free flight of the arrow.

Still another advantage of the progressive increase in arrow propelling force from a minimum at release to a maximum immediately before free flight is the minimization of the propensity of an arrow "spine", or longitudinal axis, to bend due to loads applied to the arrow by the bowstring. Such a bending of the arrow spine causes deviations from the aimed arrow path.

It is well known in this art that arrow shafts of relatively small diameter are desirable as they produce less frictional air drag than shafts of greater size, thus allowing greater arrow speed, distance potential and a flatter trajectory for greater accuracy. However, for use with bows of relatively large poundage, it is necessary to use relatively larger diameter arrow shafts to avoid spine bending. It readily may be appreciated that spine bending is caused by a larger axial load on the arrow shaft than the mechanical characteristics of the shaft can support as columnar load. Axial forces applied to an arrow shaft at rest are opposed by the inertia of the arrow and thus result in greater columnar loads, due to shock loading, than the same forces applied to a moving shaft. The prior art bows generating curves 64, 64' and 68, 68' of FIG. 5 apply greater force to the arrow when the arrow is at rest than does the bow of this invention represented by curves 72, 72'. Thus the tendency of the bow of this invention to cause arrow spine bending is less than prior art of like poundage and allows the use of an arrow spine of smaller diameter, promoting greater arrow speed and accuracy.

Figure 2:
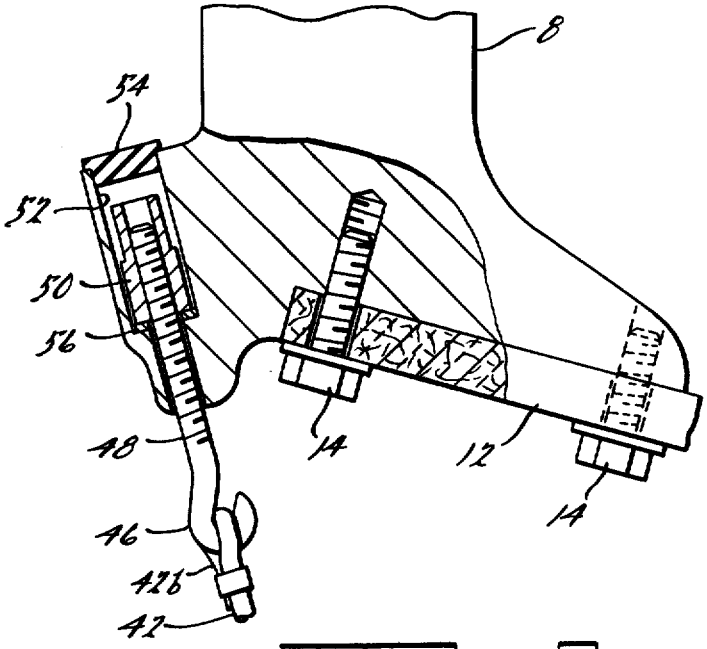
FIG. 2 is an enlarged view, partially in section of the portion of the bow FIG. 1 enclosed by the circle 2.

Referring once again to FIGS. 1 and 2 of the drawings, the advantages of the adjustability of the effective lengths of cables 40 and 42 can be seen. During the manufacture of archery bows of all types, it is of great importance that a bow be balanced by insuring that the spring characteristics of the two resilient limbs be as close to equal as possible. In the past, this balancing often has been accomplished by clamping the bow handle in a fixed position and drawing the bow while readings of instruments connected to the bowstring and/or limbs and measuring limb displacement and draw forces are observed. Since the limbs commonly are out of balance, adjustments are made reshaping the limbs by material removal using equipment such as an abrasive wheel, until an acceptable balance is achieved. This procedure often is time consuming and requires an extremely skilled and experienced workman to accomplish the requisite material removal without ruining the resilient limbs.

In the manufacture of the bow of this invention, however, adjustments for such balance may be accomplished simply by the procedure of threading the hooks 46 into and out of plugs 50 to vary the effective lengths of cables 40 and 42, and thus the at rest flex positions of limbs 10 and 12 and their resulting spring characteristics during bow draw. This adjustment feature also provides flexibility for the bow manufacturer and archer as varying the effective lengths of cables 40 and 42 serves to vary both the poundage rating of bow 6 as well as the mechanical advantages obtainable to provide let off and energy storage.

What is claimed is:

1. An archery bow comprising a handle section provided with a pair of resilient limbs extending outwardly from said handle in generally opposite directions, a bowstring having a nocking point, first means connecting said bowstring to the end portion of each of said limbs remote from said handle such that the bowstring is positioned along the length of one side of said handle and each of said limbs and said point is movable from an at rest position to a plurality of drawn, limb flexing positions upon application of drawing forces to said bowstring, each of said limbs being arcuate in shape along its length and having a convex profile along the surface of said one side that is nearest said bowstring and a concave profile along its surface that is most remote from said bowstring, said first means including pivot means coupling a portion of said first means and said limbs such that the magnitude of the drawing force necessary to hold said point in any drawn position decreases as the distance between said any drawn position and the at rest position increases.

2. The archery bow of claim 1, said pivot means comprising a pivotal connection between said portion of said first means and each of said limbs.

3. The archery bow of claim 2, further comprising pivot control means interconnecting said handle section and said portion of said first means and inhibiting freedom of relative pivotal movement between said portion of said first means and each of said limbs upon said bowstring being drawn.

4. An archery bow comprising a handle section having a pair of outwardly extending resilient limbs each terminating in an end portion remote from said handle section, each of said limbs being arcuate along its length and including a surface having a convex profile facing the bowstring, said surface of each of said limbs being oriented in the same direction, a pair of pivotal members, connecting means operatively pivotally securing each of said members to said end portion of one of said limbs, and a bowstring secured directly to each of said pivotal members such that said bowstring lies along the surface of each of said limbs and the drawing force decreases from a maximum at rest to a minimum at full draw.

5. The archery bow of claim 4, further comprising a pair of flexible pivot control members each interconnecting said handle section and one of said pivotal members, said control members being non-yieldable in tension.

6. The archery bow of claim 5, said connecting means each including a pivot pin about which one of said pivotal members pivots, each of said pivot pins, a first interconnection point between said bowstring and one of said pivotal members and a second interconnection point between said each of said control members and pivotal members defining the apices of an imaginary triangle.

7. The archery bow of claim 6, wherein said imaginary triangle is a right triangle having a side between the pivot pin and the first interconnection point comprising the hypotenuse of said right triangle.

8. The archery bow of claim 4, wherein said pivotal members are generally planar, said connecting means comprising a pair of bifurcated means each fixed to one of said limbs and having a pair of arms with a generally planar space between said arms receiving one of said pivotal members, and a pivot pin interconnecting each of said pivotal members and one of said bifurcated means, whereby pivotal swinging movement of said pivotal members is guided by said arms and restricted to swinging movement in a plane.

9. An archery bow comprising a handle section provided with a pair of outwardly extending resilient limbs each terminating in a free end portion, a bowstring, first means proximate to each of the free ends of said limbs and connected to the ends of said bowstring such that said bowstring is positioned along one side of said limbs and is movable from an at rest position to drawn limb flexing positions upon application of a drawing force thereto, each of said limbs being arcuate in shape along its length and having a convex profile along its surface that is nearest said bowstring and a concave profile along its surface that is farthest from said bowstring, pivot means pivotally securing said first means to said limbs for relative pivotal movement between said first means and said limbs during movement of said bowstring between said at rest and limb flexing positions such that the radius of curvature of said limbs is decreased as said limbs are flexed upon said bowstring being drawn from the at rest position towards the drawn positions.

10. The archery bow of claim 9, said pivot means comprising a pivotal connection between said first means and each of the free ends of said limbs.

11. The archery bow of claim 10, further comprising pivot control means interconnecting said handle section and said first means and inhibiting freedom of relative pivotal movement between said first means and each of said limbs upon said bowstring being drawn.

12. The archery bow of claim 11, said pivot control means comprising an elongate flexible member that is non-extensible in tension.

13. An archery bow comprising a handle section having a pair of outwardly extending resilient limbs, a pair of pivotal members each positioned proximate the free end of one of said limbs, a bowstring having a nocking point and secured to each of the pivotal members at a point of attachment, said nocking point movable between an at rest position and a limb flexing fully drawn position through a plurality of limb flexing partially drawn positions upon the application of manual drawing forces to said bowstring, and plural coupling means each attached to one of said limbs and each pivotally connecting one of said pivot members to one of said limbs for swinging movement about a pivot point common to said each of said coupling means and pivotal members, the construction of said resilient limbs and the geometry of said pivotal members being such that the distance between said point of attachment and an imaginary line normal to each said limb and passing through said pivot point increases substantially during movement of said nocking point from said rest position to said fully drawn position whereby the drawing force decreases from a maximum at rest to a minimum at full draw.

14. The archery bow of claim 13, further comprising pivot control means operatively connecting said pivotal members and said handle section and limiting the angular magnitude of swinging movement of said pivotal members in response to an increment of movement of said nocking point away from the at rest position.

15. The archery bow of claim 14, wherein said control means comprise a pair of flexible cables non-extensible in tension.

16. The archery bow of claim 14, further comprising adjustment means connected to said cables and operable to selectively adjust the effective length of said cables.

* * * * *